United States Patent [19]

Scheinberg

[11] Patent Number: 4,913,261

[45] Date of Patent: Apr. 3, 1990

[54] ACOUSTICAL ABSORBER

[75] Inventor: Stephen P. Scheinberg, Wilmington, Del.

[73] Assignee: E. I. Du Pont de Nemours and Company, Wilmington, Del.

[21] Appl. No.: 361,410

[22] Filed: Jun. 5, 1989

[51] Int. Cl.[4] ..... E04B 1/82

[52] U.S. Cl. ..... 181/287; 181/291; 181/295

[58] Field of Search ..... 181/210, 284–295

[56] References Cited

U.S. PATENT DOCUMENTS

| | | | |
|---|---|---|---|
| 2,959,242 | 11/1960 | Müller et al. | 181/290 |
| 4,057,123 | 11/1977 | Erickson | 181/287 X |
| 4,073,991 | 2/1978 | Focht | 428/138 |
| 4,214,646 | 7/1980 | Planes et al. | 181/287 |
| 4,446,663 | 5/1984 | Stumpf et al. | 52/144 |
| 4,584,232 | 4/1986 | Frank et al. | 428/247 |
| 4,715,473 | 12/1987 | Tschudin-Mahrer | 181/286 |
| 4,805,724 | 2/1989 | Stoll et al. | 181/290 |

*Primary Examiner*—B. R. Fuller

[57] ABSTRACT

A readily removable and replaceable acoustical absorber for mounting in a channel that utilizes a flexible grid within the absorber to support the absorber on flanges of angles mounted on the channel walls.

10 Claims, 3 Drawing Sheets

ACOUSTICAL ABSORBER

BACKGROUND OF THE INVENTION

This invention relates to acoustical absorbers and, more particularly, it relates to mounting the absorbers.

In some environments it is important that acoustical absorbers be readily removable and replaceable for cleaning, repair, etc. It is also important that such absorbers fit properly, will not burn, are environmentally inert and also can be finished to match its surroundings.

SUMMARY OF THE INVENTION

The present invention provides such an absorber for mounting in an elongated structure having a generally U-shaped cross section which is defined by rigid side and back walls. A pair of angles are fixed at directly opposed locations on the side walls within the structure with their flanges facing each other. An elongated resilient acoustical absorber having the approximate size and shape of the generally U-shaped section has notches running the length of its side edges. Each notch has a surface formed to mate with the angle flanges which then support the absorber when it is installed in the U-shaped section. The absorber is installed by inserting or mating one of the notches with a flange and then compressing the opposite notched side edge while applying a force between the edges to position the opposite side notch to mate with the other one of the flanges and compress the absorber against the back wall of the U-shaped section whereby a returning force acts on said absorber to cause it to conform to said section.

Preferably the absorber is formed from a flexible grid sandwiched between two open cell foam panels. The grid which provides support for the absorbers by resting on the flanges of the angles is preferably made from expanded metal.

In another embodiment a sound absorbing fabric layer is located within one of the foam panels and, as a safety measure, both the foam and the fabric are fire-retardant.

The foam may be selected from neoprene, urethane, polyimide foam or rubber. The fabric may be selected from woven, nonwoven, knit, synthetic or natural materials.

The acoustical resistance of the absorber is preferably in the range of from 1 to 10 $\rho c$ units where 1 $\rho c$ unit equals 41.3 cgs rayl. The absorber thickness may range from 1 to 16 inches thick but most usually ranges from 2 to 8 inches in thickness.

The mounting angles are preferably electrically nonconductive as is the expanded metal support grid. This can be achieved with metal angles and grids by coating them with a nonconductive material or, in the alternative, fabricating them from a nonconductive composite or the angles from ceramic material.

In another embodiment, the absorber is convered with a soft flexible coating such as synthetic or natural rubber latex to keep out water or other contaminants.

DETAILED DESCRIPTION OF THE ILLUSTRATED EMBODIMENT

Figure 1:
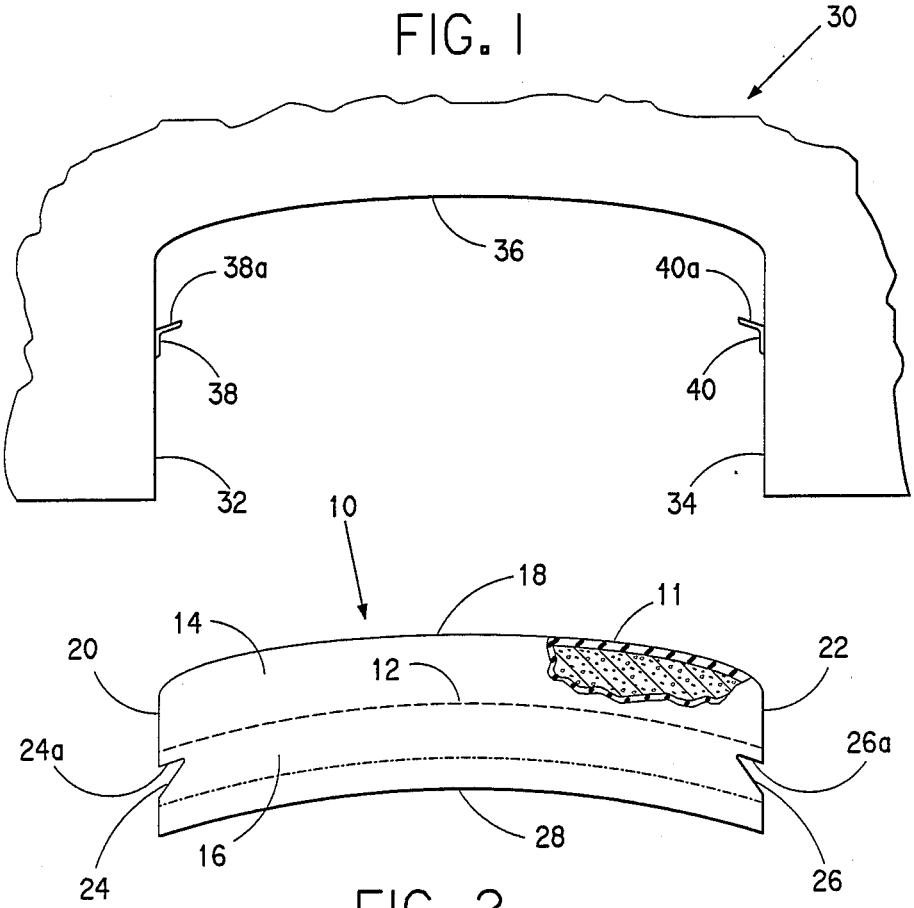
FIG. 1 is a schematic illustration of an acoustical absorber of this invention and the U-shaped structure prior to installation of the absorber into the U-shaped section.

Referring now to FIG. 1, the embodiment chosen for purposes of illustration includes an acoustical absorber 10 and a generally U-shaped section 30 into which the absorber 10 is to be installed. The U-shaped section is an elongated rigid structure having straight side walls 32, 34 connected by curved back wall 36. A pair of angles 38, 40 running the length of the section 30 are fixed to side walls 32, 34, respectively, at directly opposed locations with their flanges **38*a* and 40*a*** facing each other.

The acoustical absorber 10 comprises a flexible grid 12 sandwiched between two open cell foam panels 14, 16. The absorber is the approximate size and shape of the U-shaped section 30 into which it is to be placed. More particularly, the absorber 10 has a curved top surface 18 that matches the curved back wall 36 and side edges 20, 22 with notches 24, 26 running the length of side edges 20, 22, respectively. The upper surfaces **24*a*, 26*a* of notches 24, 26 are designed to mate with the flanges 38*a* and 40*a* when the absorber is mounted in the U-shaped section 30. The lower surface 28 of the absorber is shown to be curved in the same manner as back wall 36 and with the proper finish the surface 28 can be made to look like the surface finish of back wall 36** or to generally match its surroundings.

In the preferred embodiment an acoustically active fabric 17 is embedded in foam layer 16. The absorber 10 is covered with a soft flexible coating 11 such as synthetic or natural rubber latex.

Figure 2:
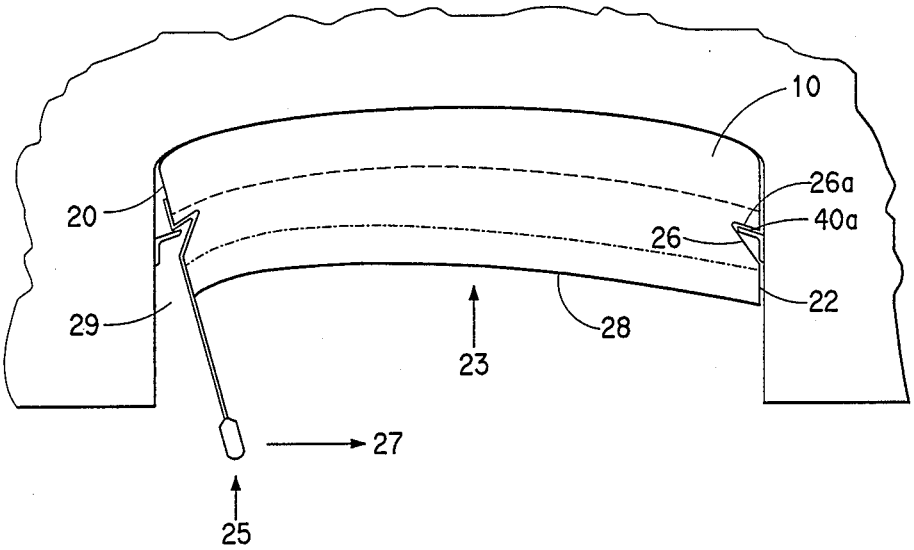
FIG. 2 is a schematic illustration of the acoustical absorber of this invention partially installed in the U-shaped section.
Figure 3:
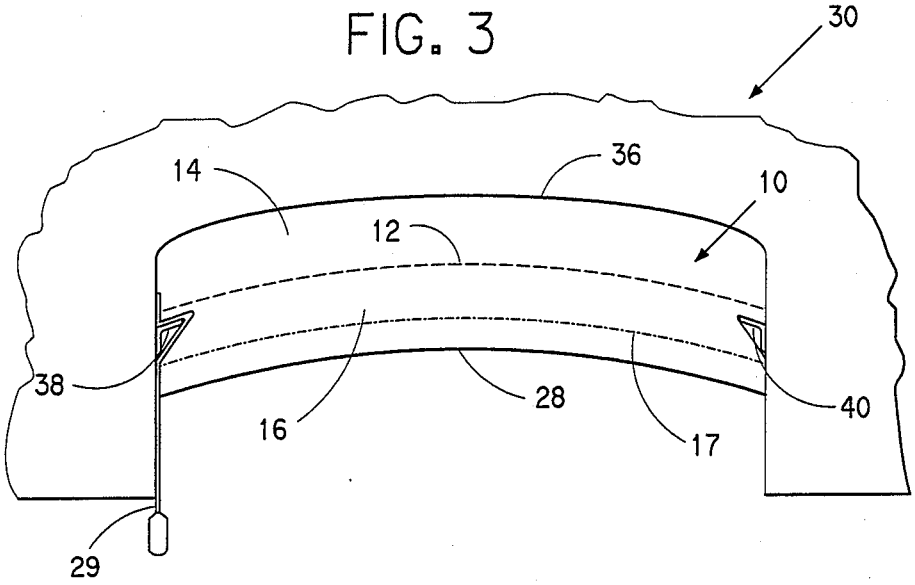
FIG. 3 schematically illustrates the acoustical absorber of this invention fully installed in the U-shaped section.
Figure 4:
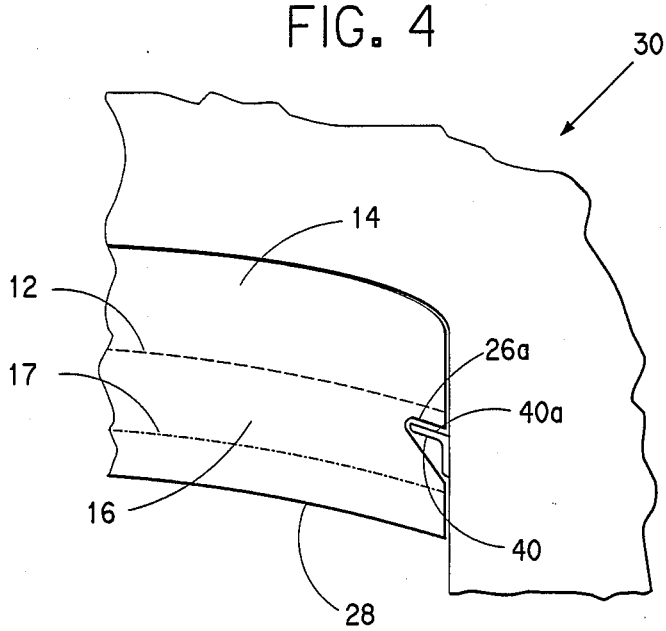
FIG. 4 is an enlarged view of one edge of FIG. 3.

FIG. 2 illustrates the installation of absorber 10 into U-shaped section 30. First the notch 26 of side edge 22 is inserted over flange **40*a* while compressing the edge 20 of the absorber with a stiff bladed tool 29 by pivoting the tool against angle 38 in the direction of the arrows 25, 27. At the same time a force is applied to surface 28 of the absorber 10 in between edges 20, 22 in the direction of arrow 23. This action allows the tool 29 and the side edge 20 of the absorber to be positioned with flange 38*a* and foam layer 14 is compressed against back wall 36. The tool 29 is worked out of the section along the angle 38 and the return force from the foam layer 14 being compressed acts to push the support grid down from the center causing it to move outward over the flanges 38*a* and 40*a* to provide a positive support and causes the foam layers to conform to the walls of the section 30 as shown more clearly in FIGS. 3 and 4**.

The removal of an absorber is accomplished with two tools 29 which are inserted on the same side over angle 38 (angles 38 and 40 are shorter than the module to allow the tools to be inserted). The tools are pushed upwardly toward back wall 36 and rotated inwardly toward the center and at the same time the center of the absorber is pushed upwardly to relieve the pressure on grid 12. Then the absorber can be pulled inward and off angle 38.

Figure 5:
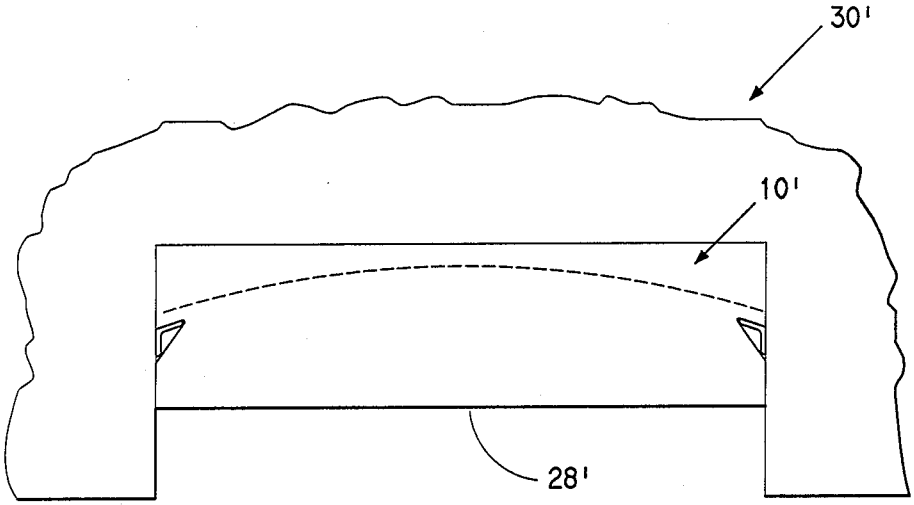
FIGS. 5 and 6 are schematic illustrations of the acoustical absorber of this invention installed in rectangular channel and concave shaped structures, respectively.
Figure 6:
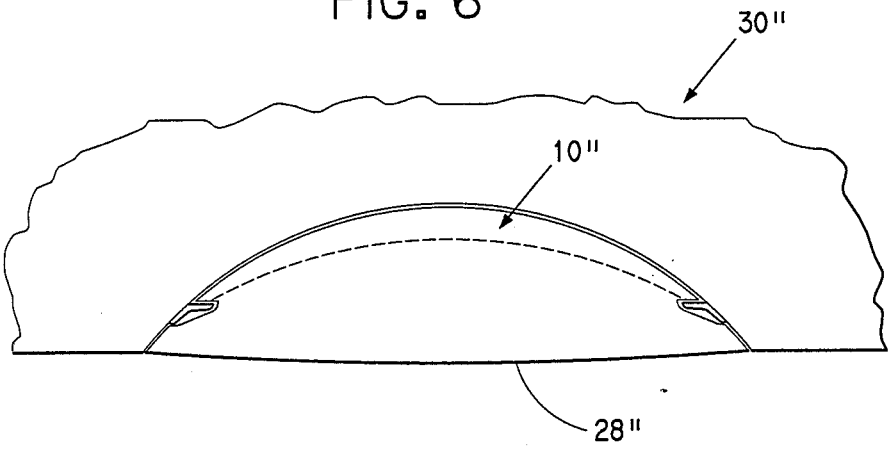

While the detailed description disclosed a generally U-shaped structure with straight side walls and a curved back wall, other shapes such as rectangular channel and concave as shown in FIGS. 5 and 6 are intended to be included as generally U-shaped structures. More particularly, FIG. 5 shows a rectangular channel section 30' as the receptor for absorber 10' which is the approximate size and shape of the receptor. In this case surface 28' of the absorber is flat. FIG. 6 shows a concave receptor 30'' with absorber 10'' installed therein. Surface 28'' is slightly convex. These are some alternate embodiments which could be applied to either wall or ceiling receptors of the same design.

What is claimed is:

1. A removable and replaceable acoustical absorber for mounting in an elongated rigid structure having a generally U-shaped section having a rigid back and side walls comprising: a pair of angles fixed at directly opposed locations on said side walls within said section with flanges facing each other, and an elongated resilient flexible acoustical absorber having two side edges, said absorber having notches along each of said side edges, each notch having a surface to mate with said flanges, so that the absorber may be inserted by first mating one of said notches with one of said flanges and then compressing the other notched side edge while applying force between the edges to position the other side notch with the other of said flanges and compress said absorber against the back wall of the U-shaped section whereby a returning force acts on said absorber to cause said absorber to conform to said section.

2. The acoustical absorber of claim 1 wherein said absorber is formed of a flexible grid sandwiched between two open cell foam panels, said grid being positioned to engage said flanges when said absorber is positioned in said structure.

3. The absorber of claim 2 including a sound absorber fabric layer placed within one of said foam panels.

4. The absorber of claim 2 wherein said foam is fire retardant neoprene.

5. The absorber of claim 2 wherein said foam is fire retardant urethane.

6. The absorber of claims 1, 2, 3, 4 or 5 wherein the acoustical absorber has an acoustical resistance in a range of from 1–10 $\rho C$ units.

7. The absorber of claim 6 wherein said absorber is covered with a soft flexible coating.

8. The absorber of claim 7 wherein the coating is latex.

9. The acoustical absorber of claim 2 wherein said flexible grid is expanded metal.

10. The acoustical absorber of claim 2 wherein said expanded metal is coated with an electrically non-conductive material.

* * * * *